US009587183B2

(12) United States Patent
Al-Sharshani et al.

(10) Patent No.: US 9,587,183 B2
(45) Date of Patent: Mar. 7, 2017

(54) INTEGRATED GAS-TO-LIQUID CONDENSATE PROCESS AND APPARATUS

(71) Applicant: SHELL OIL COMPANY, Houston, TX (US)

(72) Inventors: Ali Mohammed Ali Shahab Al-Sharshani, Doha (QA); Wilhelmus Johannes Franciscus Scholten, Amsterdam (NL); Arend Hoek, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 87 days.

(21) Appl. No.: 14/365,115

(22) PCT Filed: Dec. 17, 2012

(86) PCT No.: PCT/EP2012/075865
§ 371 (c)(1),
(2) Date: Jun. 13, 2014

(87) PCT Pub. No.: WO2013/087942
PCT Pub. Date: Jun. 20, 2013

(65) Prior Publication Data

US 2014/0326639 A1 Nov. 6, 2014

(30) Foreign Application Priority Data

Dec. 16, 2011 (EP) ..... 11193918

(51) Int. Cl.
*C10G 55/02* (2006.01)
*C10G 45/02* (2006.01)
(Continued)

(52) U.S. Cl.
CPC ..... *C10G 55/02* (2013.01); *C10G 2/332* (2013.01); *C10G 45/02* (2013.01); *C10G 47/00* (2013.01);
(Continued)

(58) Field of Classification Search
CPC ..... C10G 2/32; C10G 2/34; C10G 2300/1033
See application file for complete search history.

(56) References Cited

U.S. PATENT DOCUMENTS

2003/0143135 A1 7/2003 O'Rear et al.
2005/0252830 A1 11/2005 Treesh et al.
(Continued)

FOREIGN PATENT DOCUMENTS

EP 0582347 2/1994
GB 2388611 11/2003
(Continued)

*Primary Examiner* — Randy Boyer
*Assistant Examiner* — Juan Valencia

(57) ABSTRACT

A process for production of middle distillate fraction from gas-to-liquid (GTL) conversion comprising providing a feed stream comprising natural gas and separating a condensate from the feed stream to produce a condensate stream and a feed stream; processing the feed stream via a Fischer-Tropsch (FT) reaction to generate a long chain hydrocarbon product stream; processing the product stream via a heavy paraffinic conversion in order to produce a FT product stream; treating the condensate stream with a desulfurization step to generate a condensate product stream; combining the FT product stream with the condensate product stream to provide a distillate feed stream; and performing a distillation step on the distillation feed stream, wherein the processing steps occur substantially concurrently with the treating step and wherein distillation provides for isolation of middle
(Continued)

distillate products. Middle distillate fractions and fuel oils/fuel oil blends obtained according to the process are also provided.

11 Claims, 4 Drawing Sheets

(51) Int. Cl.

| | |
|---|---|
| ***C10G 47/00*** | (2006.01) |
| ***C10G 65/14*** | (2006.01) |
| ***C10G 2/00*** | (2006.01) |
| ***C10L 1/04*** | (2006.01) |

(52) U.S. Cl.
CPC ..... *C10G 65/14* (2013.01); *C10L 1/04* (2013.01); *C10G 2300/1025* (2013.01); *C10G 2400/04* (2013.01); *C10G 2400/06* (2013.01); *C10G 2400/08* (2013.01)

(56) References Cited

U.S. PATENT DOCUMENTS

| | | | | |
|---|---|---|---|---|
| 2011/0130474 | A1* | 6/2011 | Moon | B01J 19/0093<br>518/702 |
| 2011/0240288 | A1* | 10/2011 | Kibby | C10G 2/32<br>166/267 |

FOREIGN PATENT DOCUMENTS

| | | |
|---|---|---|
| WO | 9410264 | 5/1994 |
| WO | 03070857 | 8/2003 |
| WO | 2006067176 | 6/2006 |
| WO | 2010122025 | 10/2010 |

* cited by examiner

INTEGRATED GAS-TO-LIQUID CONDENSATE PROCESS AND APPARATUS

PRIORITY CLAIM

The present application is the National Stage (§371) of International Application No. PCT/EP2012/075865, filed Dec. 17, 2012, which claims priority from European application no. 11193918.7, filed Dec. 16, 2011, the disclosures of which are incorporated herein by reference.

FIELD OF THE INVENTION

The invention is directed towards a process and apparatus for performing gas-to-liquid (GTL) conversion, specifically with relation to natural gas conversion via Fischer-Tropsch reaction to produce middle distillate fuels or fuel blends.

BACKGROUND OF THE INVENTION

As reserves of easily accessible oil become more scarce there has been an increasing trend to look towards other sources of hydrocarbons in order to meet current needs for fuels and other petrochemical products. It has been known to utilise GTL technology in order to convert natural gas into heavier hydrocarbons. Natural gas is currently readily available in a number of locations that are easily accessible and, as a result, it represents a promising starting point for hydrocarbon conversion.

Dry natural gas, after extraction of liquid petroleum gas (LPG) and optionally ethane, can be transported either by pipeline or as liquid natural gas (LNG) or may be readily converted at the location of gas production to heavier liquid hydrocarbons via the GTL process. The GTL process is based on Fischer-Tropsch synthesis. The resulting GTL products include a wide variety of hydrocarbons that can be transported more easily than LNG.

There are significant new GTL projects—particularly in the Arabian Gulf region—that are currently coming on stream and will be expected to produce in excess of 200,000 barrels/day of GTL products by the end of 2020.

GTL products typically have a paraffinic nature which provides these products with special characteristics. They are virtually free of sulphur and aromatics and have a high cetane number making them particularly desirable as fuels. The typical output from a GTL process may include condensate, light paraffins, naphtha, middle distillates and base oils. The middle distillate products typically include paraffinic kerosene and diesel. For fuel products of GTL conversion there is a need to blend with conventional crude or condensate derived products in view of the required properties for end use, such low density as the density of GTL fuels is generally low. In 2009 the first synthetic paraffinic kerosene was approved for use in the aviation industry and comprised a blend of conventional aviation jet fuel with 50% GTL derived kerosene. In October of 2009 Qatar Airways jointly with Shell and Rolls-Royce flew the first flight from London's Gatwick Airport to Doha in Qatar fuelled entirely by a GTL fuel blend.

There is a need for producing high levels of GTL middle distillate products that can be used as a basis for fuel blends and for other paraffinic hydrocarbon based products. There exists an ongoing need for improved GTL processes in general. In addition, there is a need for increased utilisation of condensate obtained as a by product of natural gas extraction within the existing GTL processes or as a by product of other natural gas processes such as LNG production.

US-2005/0252830-A1 describes processes for introducing condensate recovered from a natural gas extraction process into the liquid fraction of a product derived from a high temperature Fischer-Tropsch reactor and subsequently processing in a hydrotreater. The process described in US-2005/0252830-A1 is intended to occur after GTL processing of a natural gas feedstock has occurred, and as a result, requires additional levels of fractionation prior to initiation of the described process. Practical application of the described process is limited as it requires additional levels of equipment to be introduced to a conventional GTL process.

EP-1853682-A describes a catalytic conversion of a combined stream of condensate and paraffins obtained from a Fischer-Tropsch reaction in order to prepare a lubricating base oil. EP-1853682-A does not describe processes for the preparation of middle distillate products and is concerned primarily with production of heavier hydrocarbons for lubricating base oil purposes.

It is an object of the invention to provide an improved process for GTL preparation of middle distillate products that includes utilisation of condensate produced as a by-product of natural gas extraction.

It is a further object of the invention to provide improved GTL performance particularly with regards to the conversion of heavy paraffinic hydrocarbons into shorter chains via the process of cracking.

SUMMARY OF THE INVENTION

The present inventors have surprisingly identified that an improved yield of naphtha, middle distillate products including kerosene and diesel/gas oil, may be obtained through a GTL process in which processing of condensate occurs substantially simultaneously with the Fischer-Tropsch conversion of natural gas to heavier hydrocarbons. As a consequence, combining the output of the Fischer-Tropsch conversion together with that of a hydrotreated condensate prior to a distillation step enables greater utilisation of starting materials and higher end yield of middle distillate end products than was previously known.

In a first aspect the invention provides a process for the production of a middle distillate fraction from a gas-to-liquid (GTL) conversion comprising the step of:

(a) providing a feed stream comprising a natural gas and a condensate and separating a condensate from the natural gas feed stream to produce a condensate feed stream and a natural gas feed stream;

(b) preparing a mixture of carbon monoxide and hydrogen from the natural gas feed stream obtained in step (a);

(c) preparing a long chain hydrocarbon product stream by performing a Fischer-Tropsch reaction using carbon monoxide and hydrogen obtained in step (b);

(d) Subjecting the long chain hydrocarbon product stream to a hydrocracking/hydroisomerization step to obtain a hydrocracked/hydroisomerised Fischer-Tropsch product stream;

(e) treating the condensate stream of step (a) with a desulfurization step to generate a condensate product stream;

(f) combining the hydrocracked/hydroisomerised Fischer-Tropsch product stream of step (d) with the condensate product stream of step (e) in order to provide a distillation feed stream; and (g) performing a distillation step on the distillation feed stream, wherein the distillation step provides for isolation of middle distillate products; wherein the steps (c) to (d) occur substantially concurrently with step (e).

In a further embodiment of the invention all steps (a)-(g) occur at a single location.

Typically the step of separating condensate from natural gas will occur within a feed gas preparation (FGP) processor or reactor and will include the steps of acid gas removal and dehydration.

In a Fischer-Tropsch reaction synthesis gas is converted to a synthesis product. Synthesis gas or syngas is a mixture of hydrogen and carbon monoxide that is obtained by conversion of a hydrocarbonaceous feedstock. Suitable feedstock include natural gas, crude oil, heavy oil fractions, coal, biomass and lignite. In one embodiment of the invention the Fischer-Tropsch reaction is a low temperature Fischer-Tropsch (LIFT) reaction. In a further embodiment of the invention the Fischer-Tropsch reaction is a high temperature Fischer-Tropsch (HTFT) reaction. The Fischer-Tropsch product stream is typically subjected to heavy paraffinic conversion (HPC), which will suitably involve the process of catalytic cracking.

In an embodiment of the invention the condensate typically comprises hydrocarbons within the range of at least $C_3$ to at most around $C_{25}$, the condensate may be further processed in order to remove hydrocarbon content of less than $C_4$.

The hydrotreating process suitably comprises a step of removable of any sulfur compounds from the condensate—referred to as desulfurization.

In a second aspect of the invention the process comprises an additional step of dividing the long chain hydrocarbon product stream of step (c) in to a light Fischer-Tropsch (FT) product stream, which product stream comprises hydrocarbons of around C5 to around C20 and a heavy product stream, which product stream comprises hydrocarbons of around C20 and above including the majority of the paraffin wax components of the Fischer-Tropsch reaction step, and combining the light product stream with either:

(i) the condensate feed stream; or (ii) the condensate product stream; or (iii) both the condensate feed stream and the condensate product stream, prior to the distillation step (g).

In a third aspect of the invention the process comprises an additional separation step of dividing the FT product stream of step (c) in to light FT and heavy FT product streams, and providing an additional separation step for the light FT product stream so as to divide the light FT product stream in to a very light FT products comprising $C_5$-$C_8$ hydrocarbons and other FT products comprising $C_9$-$C_{20}$ hydrocarbons which may be processed further in a hydrogenation step to remove olefins and oxygenates, and optionally redistillation, or recombined with the heavy FT product stream as feedstock for a hydrocracking/hydroisomerisation step.

The very light FT product may be combined with the condensate feed stream.

In a specific embodiment of the invention, the process as described above may occur wherein steps (d) and (e) are carried out within in a single reactor. Typically, a suitable catalyst system that allows for a combined or consecutive hydrodesulfurization and hydrogenation conversion is used in this embodiment of the invention.

In a fourth aspect of the invention, there is provided a middle distillate fraction that has been prepared according to the processes of the invention. The middle distillate may suitably comprise one or more of the group consisting of: a middle distillate kerosene and/or a middle distillate gas oil or diesel oil component.

In a fifth aspect, the invention provides for a blended fuel, wherein the fuel comprises between 0.1% and 100% of a middle distillate fuel obtained according to the process of the invention, wherein the percentage is by weight (i.e. % wt) of the total fuel composition. Typically the blended fuel of the invention comprises between 1% and 95% of a GTL derived fuel of the invention. Suitably the blended fuel oil may comprise between at least 5% and at most 90%, suitably between 10% and up to 75%, optionally at least 20% and up to 50%, and more typically at least 50% of a GTL fuel oil obtained according to the methods in the present invention. The balance of the blended fuel composition will suitably comprise a fuel (including kerosene or diesel oil) obtained from non-GTL sources including, but not limited to, condensate or conventional crude oil or light tight oil.

The present inventors have advantageously identified that a more efficient GTL process can be provided when the condensate processing steps and the GTL steps occur substantially concurrently and within the same processing facility compared to previously known processes where these processes occurred at separate locations or were separated in time. In addition to savings of time, additional apparatus and reduced overall additional handling it has also been found that the levels of waste condensate generated from natural gas extraction and processing are substantially reduced thereby also reducing the effluent burden of the process as a whole. Condensate sells at a value close to that of naphtha whereas middle distillates sell at a higher value. By integrating the processing of naphtha and of Fischer-Tropsch (F-T) product from the same gas field the middle distillates fraction present in the condensate can be sold at higher value. Moreover the naphtha present in the condensate is combined with the GTL naphtha and can be sold as a finished product without further processing requirement. This leads to higher overall product value. Additional advantages identified in specific embodiments of the invention will become apparent to the skilled person as the invention is described in more detail.

DRAWINGS

The invention is further illustrated in the accompanying drawings in which.

DETAILED DESCRIPTION OF THE INVENTION

The present invention relates to an improved GTL process that utilises gas field condensate obtained from natural gas extraction to contribute to production of middle distillate fraction products. The condensate will be derived from natural gas of subterranean formation that will have been obtained via a conventional well extraction process. Condensates are typically used for heavy oil diluent blends and as refinery and petrochemical feedstocks. A typical gas field condensate will contain substantial levels of sulfur. The sulfur content of the raw condensate will usually be significantly in excess of 20 ppm.

The invention will be described in more detail with reference, where appropriate, to the accompanying figures. It will be understood by the skilled person that the process as described involves several steps or phases during which feed streams are converted into product streams. The process of the invention is provided as a sequence of these steps/phases but it will be appreciated by the skilled person that each step may include one or more sub-steps as is necessary to effect the required conversion. In addition, each step or phase may not necessarily refer to a single reactor but may refer to a configuration whereby one or more reactors are arranged in series or in parallel in order to achieve the requisite conversion of feed stream to product stream for that particular step/phase.

Figure 1:
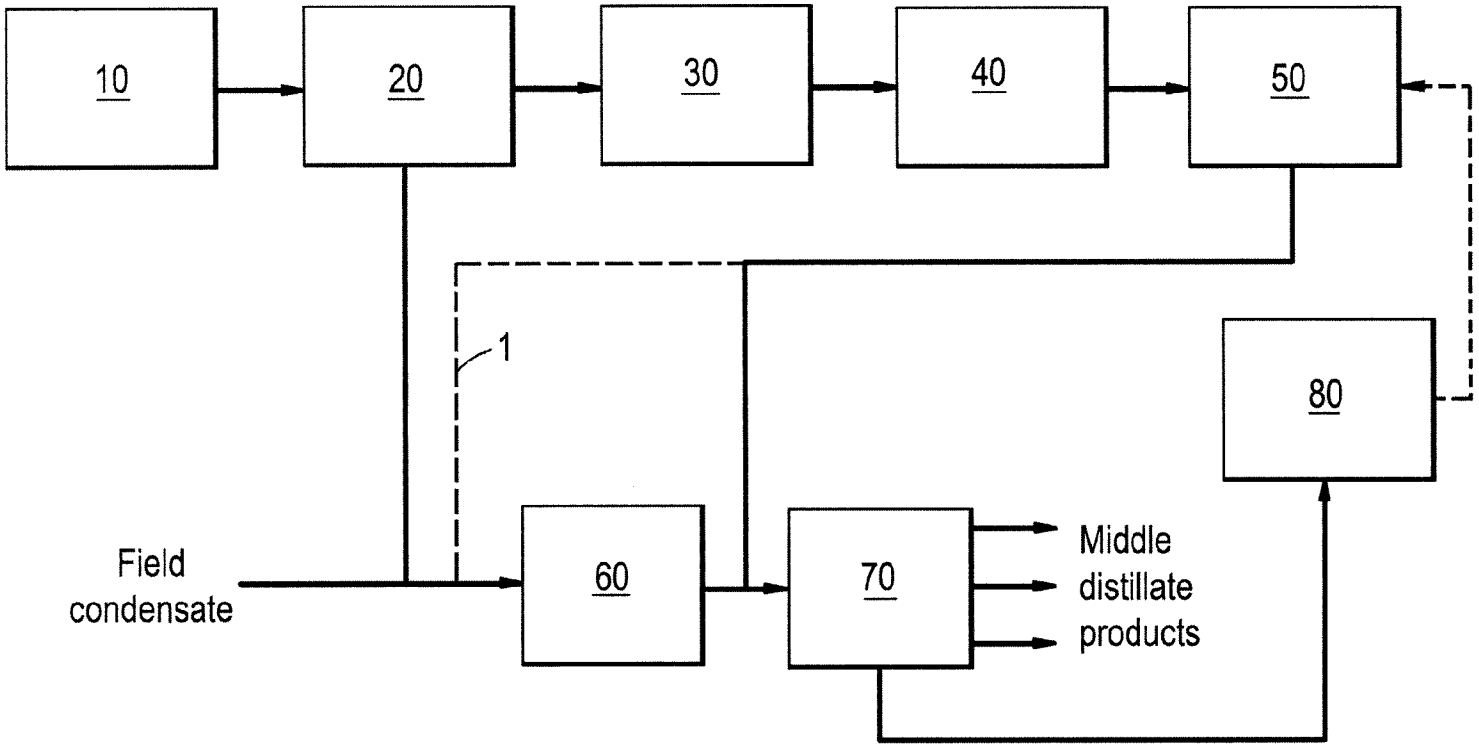
FIG. 1 shows a schematic flow diagram of a first embodiment of the invention.

As shown in FIG. 1, natural gas is obtained from a well (10) and is transported via pipeline, as liquefied natural gas (LNG) or as compressed natural gas (CNG) to a feed gas preparation (FGP) facility (20) which enables processing and/or conditioning of the natural gas feed gas. The well (10) may be located on-shore or off-shore. The FGP (20) facility removes acid gas components, including carbon dioxide, as well as dehydration of the natural gas feed gas. Following removal of these unwanted components the condensate can also be separated from the natural gas in order to provide a natural gas feed stream and a separated condensate feed stream (plant condensate). Separation of condensate from natural gas within the FGP (20) can be performed by cooling the gas to a temperature and pressure at which hydrocarbons having greater than 3 or more carbon atoms condensed and are separated from the natural gas. Cooling may be performed by indirect heat exchange against liquid nitrogen or by other methods known in the art. Preferably the gas is lowered from a pressure exceeding 50 bars to a pressure below 40 bars, typically below 30 bars.

After separation of the fraction comprising hydrocarbons in the range of C3 to C4, also known as LPG (not shown), the natural gas feed streams leaves the FGP (20) facility and is directed to a synthesis gas preparation facility (SGP) (30) which involves conversion of the methane within the natural gas into synthesis gas for use in a Fischer-Tropsch process. Synthesis gas comprises a mixture of carbon monoxide and hydrogen and is typically made from the natural gas feed stream by conventional techniques such as partial oxidation and/or steam-methane reforming.

Adjustment of the ratio of hydrogen to carbon monoxide may occur in the SGP facility (30). The hydrogen/carbon monoxide ratio of the synthesis gas may be at least 1.3 and at most 2.3, typically it is between at least 1.6 and at most 2.1. Any additional amounts of hydrogen generated in the SGP (30) may be used in other aspects of the process including in the later hydroconversion (cracking) and hydrotreating steps of the process.

Synthesis gas, comprising a mixture of carbon monoxide and hydrogen, produced within the SGP (30) exits via a synthesis gas feed stream which is subjected to the Fischer-Tropsch reaction within the heavy paraffinic synthesis (HPS) phase of the process (40) catalysts used for the catalytic conversion of synthesis gas in to hydrocarbons within the HPS (40) are known in the art. Typically the catalysts comprise a metal from Group VIIIB of the Periodic Table of Elements. Suitable catalytically active metals include ruthenium, iron, cobalt and nickel. In a specific embodiment of the present invention the catalytically active metal used in Fischer-Tropsch process of the invention is cobalt.

The catalytically active metal is suitably supported on a carrier substrate. The carrier substrate is typically a porous carrier and may be selected from suitable metal oxides, silicates or combinations of such materials. Examples of preferred porous carriers include silica, alumina, tetania, zirconia, ceria, gallia and mixtures thereof. A suitable carrier includes alpha-alumina.

The catalyst may also comprise one or more metals or metal oxides as co-promoters. Suitable metal oxide co-promoters may be selected from Groups IIA, IIIB, IVB, VB, VIB of the Period Table of Elements, or the actinides and lanthanides series. The catalytic conversion process can be performed under conventional Fischer-Tropsch synthesis conditions.

The reaction may occur within a Fischer-Tropsch reactor selected from a fixed bed reactor, a slurry phase reactor or a two phase fluidised bed reactor. Typically a fixed bed Fischer-Tropsch reactor operates under what is termed a 'low temperature' of at least 150° C. and at most 250° C. Typically a low temperature Fischer-Tropsch (LTFT) reactor would operate at least 180° C. and at most 220° C. It is typical that the pressure for the catalytic conversion process would be in the range of at least 1 to at most 200 bar absolute, more suitably between at least 10 to at least 70 bar absolute. Under high temperature Fischer-Tropsch (HTFT) reaction conditions, typically a two phase fluidised bed reactor would be used operating at a range of at least 250° C. up to at most 315° C. It will be appreciated that the reaction conditions used during the Fischer-Tropsch step will have a direct impact upon the composition of the Fischer-Tropsch product stream and that, ultimately, this may also influence the fractions obtained as middle distillate from the distillation phase (70) downstream in the process. In particular, the catalyst selection and operating temperature of the Fischer-Tropsch reactor has been found by the inventors to affect the final product yield and characteristics. In a specific embodiment of the invention the selection of cobalt as the catalyst and a low temperature fixed bed reactor format for the Fischer-Tropsch reaction provides an improved distribution of hydrocarbons in the range between $C_5$ and $C_2$ as output from the downstream distillation step (70). This carbon range is considered to fall within the middle distillate fraction and allows for advantageous isolation of the desirable kerosene and gas oil-diesel of the invention. In one example of the invention in use a lower than expected operating temperature was able to be used in the process of the invention of around 200° C. and yet the paraffinic content of the middle distillate was substantially higher with insignificant levels of aromatic contamination and no detectable levels of oxygenates. This product distribution was significantly improved compared to that obtained from a high temperature Fischer-Tropsch fluidised bed reaction using an iron catalyst where high levels of olefin, aromatic and oxygenate contaminants were present in the middle distillate fraction. It will be understood that for uses such as aviation fuel the presence of contaminants in GTL derived fuel is highly undesirable and requires costly additional levels of additional processing in order to purify the fuel composition further.

Following Fischer-Tropsch conversion a long chain hydrocarbon product stream is directed from the reactor (40) towards a heavy paraffinic convertor (HPC) (50) whereupon the process of hydrocracking/hydroisomerisation of the long chain hydrocarbons can occur. The long chain hydrocarbon product stream comprises a high level of waxy paraffin product, although may also comprise shorter chain hydrocarbons as well. Typically, the paraffin product stream comprises at least 10 wt. % of olefinic molecules and at most 30 wt. % of olefinic molecules and comprises at least 70 wt. % of paraffinic molecules and at most 90 wt. % of paraffinic molecules. The conversion step (50) involves hydrocracking/hydroisomerisation in the presence of a suitable catalyst and hydrogen, which would be understood to those skilled in the art. Suitable conversion catalysts comprise noble metals including platinum supported on an amorphous silica-alumina (ASA) carrier. Examples of suitable noble metal on (ASA) catalysts are, for instance, disclosed in WO-A-9410264 and WP-A-0582347. Typically the paraffinic product feed will be contacted with hydrogen in the presence of the catalyst at an elevated temperature and pressure. Suitable temperature will typically be in the range of from at least 175 to at most 425° C., typically in excess of 250° C. and up to around 400° C. The hydrogen partial pressure may be suitably in the range of from at least 10 to at most 250 bar and suitably at least 20 and at most 100 bar. The hydrocarbon paraffinic Fischer-Tropsch feed may be provided that a weight hourly space velocity of from 0.1 to 5 kg/l/hr (mass feed/volume catalyst bed/time). Hydrogen may be provided at a ratio of hydrogen to Fischer-Tropsch paraffinic feed from 100 to 5,000N1/kg and typically from at least 250 to at most 2,500N1/kg.

The Fischer-Tropsch product feed leaves the HPC (50) and may proceed directly to the distillation apparatus (70) (not shown) or may be combined with the desulfurized hydrotreated condensate product stream prior to entering the distillation phase (as shown in FIG. 1). In a further embodiment of the invention the Fischer-Tropsch product feed may be combined with the condensate prior to treatment in a bulk hydrotreatment desulfurization (HDS) process (60) (see dotted line 1 in FIG. 1). An advantage of this latter embodiment is that inserts an additional hydrogenation step that allows for isomerisation of the Fischer-Tropsch product stream prior to distillation.

Condensate obtained from the FGP step (20), which is typically indicated as treated or plant condensate, is directed towards a bulk HDS process (60). It is optional to combine the treated condensate, with additional condensate obtained from other sources, which is typically indicated as field condensate, for example via bulk shipment, from oil extraction or from well 10 (not shown). The combined condensate feed stream enters the bulk HDS phase (60), whereupon desulfurization of the condensate occurs via conventional means. Typically, the hydrodesulfurization reaction takes place in a fixed-bed reactor at elevated temperatures ranging from between at least around 300° C. up to around 400° C. and at elevated pressure ranging from at least around 30 up to at most around 130 atmospheres of absolute pressure. The hydrodesulfurization reaction may occur suitably in the presence of a catalyst consisting of an aluminium oxide carrier (e.g. alumina) which is impregnated with a combination of either cobalt and molybdenum (a CoMo catalyst) or nickel and molybdenum (a NiMo catalyst).

Hydrotreated and desulfurized condensate leaves the bulk HDS (60) step and may be combined, as mentioned previously, with the Fischer-Tropsch product stream from the HPC step (50) prior to the distillation step (70).

The distillation step (70) allows for production of a range of hydrocarbon products comprising both Fischer-Tropsch (GTL) derived and condensate derived hydrocarbons via fractional distillation. The distillation step (70) comprises a standard fractional distillation process, for example a conventional column distillation configuration. In a specific embodiment of the present invention the process advantageously provides for the isolation of desirable middle distillate products. The term "middle distillate fraction" herein refers to the hydrocarbonaceous product boiling in the range of from at least 140° C. to at most 400° C. (ASTM D86) and typically having a carbon range of between at least $C_9$ and at most $C_{24}$. This middle distillate range comprises a kerosene fraction (usually boiling off from around 140° C. to about 230° C.) and a Diesel/gasoil fraction (usually boiling off from about 230° C. to 400° C.). The product respective fractions obtained may be employed as kerosene for use as aviation fuel, and a higher boiling Diesel/gasoil for primary use in compression ignition engines.

In one embodiment of the invention the condensate product stream is subjected to a distillation step (70) before being combined with the product of the Fischer-Tropsch product stream. Hence, a middle distillate fraction is obtained from the condensate only and then subsequently combined with middle distillate fractions obtained from a separate distillation of the Fischer-Tropsch converted product stream (not shown).

In a further related embodiment, the condensate derived middle distillate is divided in to naphtha, kerosene and gas oil fractions and the kerosene fraction is blended with GTL obtained kerosene fraction from the Fischer-Tropsch product stream in order to produce a final blended product comprising a portion of GTL kerosene and a portion of non-GTL derived kerosene. In this way, the process of the present invention is capable of generating a final product that comprises blended GTL and non-GTL obtained blended middle distillate products without requiring a separate supply of oil-derived middle distillate from an external source.

In examples of products of the invention manufactured according to the described process, blended kerosene will have a GTL kerosene content of between around 50% wt and 98% wt; blended naphtha around 50% wt of GTL naphtha; and blended Diesel/gasoil around 95% wt of GTL Diesel/gasoil, with the balance made up from the respective non-GTL middle distillate fractions.

Figure 2:
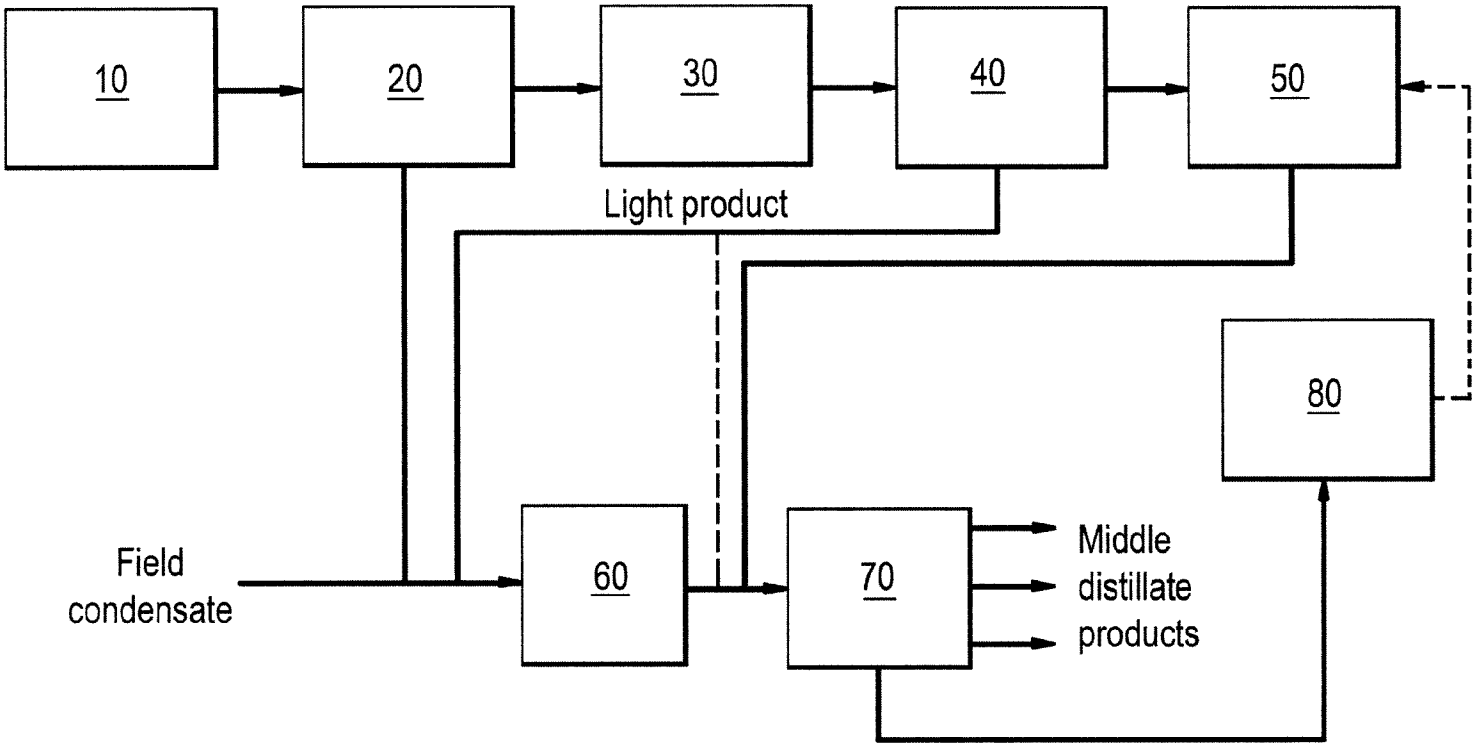
FIG. 2 shows a schematic flow diagram of a second embodiment of the invention.

FIG. 2 shows a second embodiment of the process of the invention that is similar in many respects to the process shown in FIG. 1 and described above but which differs with regards to handling of the products obtained from the Fischer-Tropsch reaction step (40). In this embodiment of the invention, the products of the Fischer-Tropsch reaction are divided into two product streams: a light Fischer-Tropsch (FT) product stream (also referred to as light ends) and a heavy Fischer-Tropsch (FT) product stream (also referred to as heavy ends). The light product stream typically comprises hydrocarbons with a distribution in the range of around $C_5$ to around $C_{20}$. Preferably, the light product stream comprises hydrocarbons in the range from C5 to C22, more preferably hydrocarbons in the range from C5 to C22. The heavy product stream typically comprises hydrocarbons of around $C_{20}$ and above including the majority of the paraffinic wax components of the Fischer-Tropsch reaction step (40). The heavy product stream is directed to the HPC (50) whereupon the process of cracking the long chain hydrocarbons can occur. In a specific embodiment of the invention the light product stream may be diverted to the HDS (60) either directly (not shown) or following prior combination with the condensate feed stream (as shown in FIG. 2). This embodiment of the invention shows particular process advantages over configurations where both heavy and light ends are combined into a single stream that passes into the HPC (50). One problem of including light end components in the feed stream for the HPC (50) is that it results in a lowering of the hydrogen partial pressure within the HPC (50). This results in a requirement to increase the total system pressure in order to maintain the efficiency of the conversion reaction and thus increases the operating cost of the process. In addition, the presence of light ends in the feed stream for the HPC (50) also leads to an associated loss of product yield due to cracking of these light ends. In fact, since the light ends require only minimal further processing (such as hydrogenation to remove olefins and oxygenates) it is advantageous from a cost of running perspective to divert them from the HPC step (50) and to combine them with the condensate feed stream or route them directly to the HDS step (60). In a further embodiment the invention a portion of the light ends may be combined with the product stream from the HDS process (60) as shown by the dotted line in FIG. 2. This embodiment allows for control of the amount of additional feed entering the bulk HDS (60) as well as finer control over the feed stream for the distillation step (70). It will be appreciated that if substantially all of the light product from the Fischer-Tropsch reaction step (40) is combined with the condensate feed stream then there will be a requirement for a larger bulk HDS reactor (60). In addition, the requirements for the HDS step (60) are, in part, dependent upon the starting composition of the condensate. Condensates low in sulphur may require a smaller bulk HDS reactor (60), in which case a substantially reduced amount of the light product may be combined with condensate prior to the hydrodesulfurization step (60). The level of control available at this step in the process allows for considerable efficiency savings and provides an advantage over known process arrangements.

Figure 3:
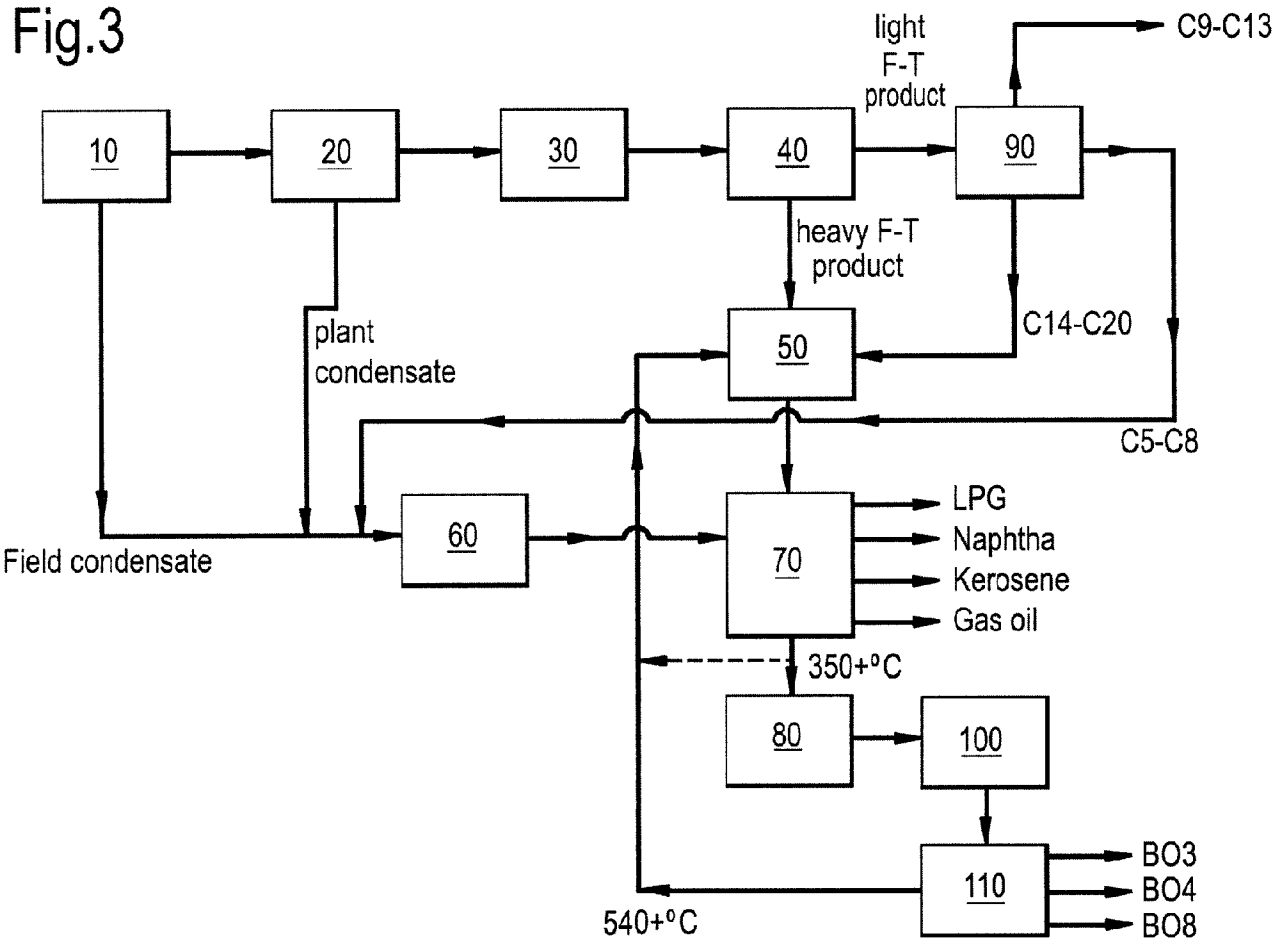
FIG. 3 shows a schematic flow diagram of a third embodiment of the present invention.

FIG. 3 shows another embodiment of the process of the invention that is similar in many respects to the process shown in FIGS. 1 and 2 and described above but which differs further with regards to handling of the light Fischer-Tropsch (FT) end products obtained from the Fischer-Tropsch reaction step (40). As shown in the second embodiment, described in detail above, there are some advantages to separating the light and heavy ends at this point in the process. As shown in FIG. 3 a heavy FT product stream proceeds from the Fischer-Tropsch reaction step (40) to the HPC (50) directly for catalytic cracking. Light FT product stream is diverted to a light products processing step (90) which may comprise a hydrogenation unit (HGU) for conversion of light olefinic components and light oxygen containing components into paraffins. With light olefinic components is meant compounds comprising at least 10 wt. % of olefinic molecules and at most 30 wt. % of olefinic molecules and comprising at least 70 wt. % of paraffinic molecules and at most 90 wt. % of paraffinic molecules. With paraffins is meant compounds comprising more than 90 wt. % of n-paraffins, preferably more than 95 wt. % of n-paraffins. In addition the light products processing step (90) is able to separate the hydrogenated light products into product streams graded by size into a FT product comprising $C_5$-$C_8$ hydrocarbons a FT product comprising $C_9$-$C_{20}$ hydrocarbons. As shown in FIG. 3, very light FT products having size of around $C_5$-$C_8$ are directed to the HDS step (60), or alternatively may be either combined with the condensate feed stream prior to the HDS step (see dotted line 1 in FIG. 3) or with the product stream from the HDS step (60) (not shown). Hydrocarbon FT products in the range of $C_9$-$C_{20}$ may be directed to the hydroconversion step (50) or may be further separated by size, for example, into $C_{14}$-$C_{20}$ and $C_7$-$C_{13}$, or $C_7$-$C_{17}$ hydrocarbon streams. The $C_{14}$-$C_{20}$ are typically diverted to the hydroconversion step (50) where due to their relatively larger size they do not contribute to loss of yield or depletion of hydrogen partial pressure as described above. $C_7$-$C_{13}$ the hydrocarbon stream may be utilised separately, for example as a feed for light detergent production. As an alternative, a $C_7$-$C_{17}$ hydrocarbon stream may be utilised as a feed for heavy detergent production.

In a preferred embodiment of a process as described in FIG. 3, light FT product stream is diverted to a light product processing step (90*a*) which separate the light FT product stream into FT product comprising $C_5$-$C_8$ hydrocarbons, FT product comprising $C_9$-$C_{13}$ hydrocarbons and a FT product comprising $C_{14}$-$C_{20}$ hydrocarbons. The very light FT products comprising $C_5$-$C_8$ hydrocarbons are directed to the HDS step (60), which step may hydrogenate the very light FT product from a FT product comprising light olefinic components and light oxygen containing components into a FT product comprising paraffins.

A minor proportion of heavier hydrocarbon fractions that fall outside of the desired middle distillate product range (referred to as distillate bottoms) are separated from the distillation phase (70) and may be subjected to an additional heavy product processing step (80) (see FIGS. 1, 2 and 3). Since both the treated condensate and hydroconverted Fischer-Tropsch products that serve as the basis for the distillation step (70) tend to have a hydrocarbon range that is largely below $C_{25}$ the heavier hydrocarbon fraction having a boiling point above 350° C. produced by the present process is low. The heavy product processing step (80) may include additional distillation steps including processing in a high vacuum unit (HVU) wherein tops from the HVU are optionally recycled to the hydroconversion step (50) (shown as a broken line in the Figures) thereby further improving yield of desirable middle distillate fractions. Alternatively or in addition, the heavy product processing step (80) may include catalytic dewaxing (100) of the heavy hydrocarbon product and optionally re-distillation (110) in order to generate base oils suitable for use as lubricants.

Figure 4:
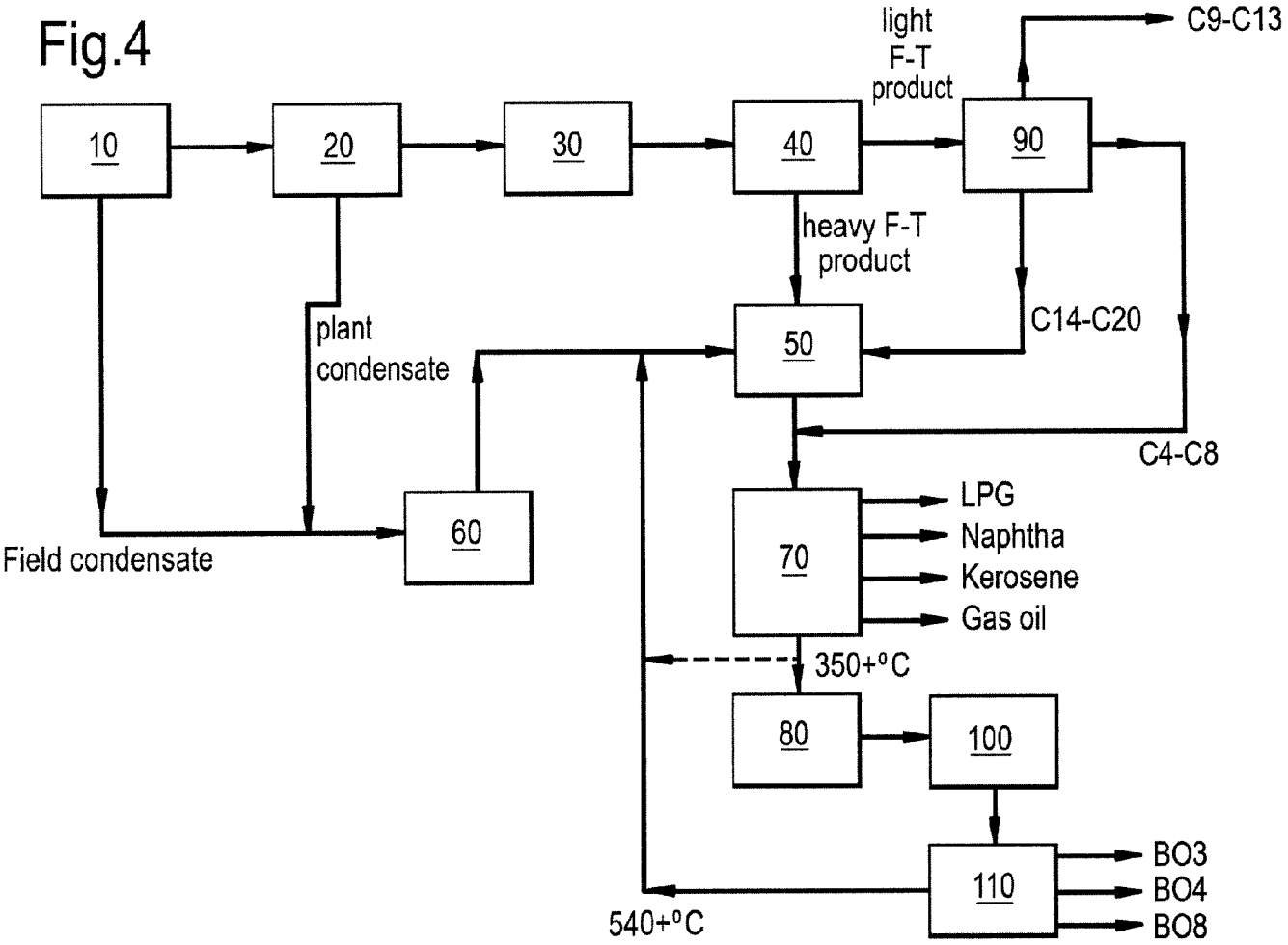
FIG. 4 shows a schematic flow diagram of a fourth embodiment of the present invention.

FIG. 4 shows another embodiment of the invention that is similar to the other embodiments described previously but which routes several product streams through the hydroconversion step (50). In one embodiment of the invention the HDS (60) and HPC (50) are connected in series or optionally combined into a single hydrodesulfurization/hydroconverter reactor. This arrangement may be suitable in instances where the condensate feed is known to contain relatively low levels of sulphur. Appropriate catalyst choice allows for the combination of the HDS (60) and HPC (50) reactors into a single reactor system (not shown in FIG. 4). For example, a catalyst system comprising at least one Group VI B metal and at least one Group VIII B metal on a solid support (such as alumina) may be suitable. In a particular embodiment of the invention the catalyst may comprise a nickel-tungsten (Ni—W) catalyst. In a particular embodiment of the invention the combined reactor is a stacked bed reactor and the catalyst system includes either a nickel-molybdenum/nickel-tungsten (Ni—Mo/Ni—W) arrangement or cobalt-molybdenum/nickel-tungsten (Co—Mo/Ni—W) arrangement. A further advantage of this embodiment is that the majority of feeds (from the GTL process as well as the condensate) are exposed to hydrogenation, deoxygenation and isomerisation steps, thereby resulting in maximal paraffinic conversion prior to the distillation step (70).

The invention is further exemplified in the accompanying Example.

EXAMPLES

Example 1

In this example the middle distillate products of a process of the invention following the scheme shown in FIG. 1 is compared to products obtained from comparative GTL processes that do not include the step of concurrent condensate processing and integration.

Comparative example 1—low temperature fixed bed Fischer Tropsch reactor using a cobalt based catalyst and an operating temperature of around 200° C.

Comparative example 2—low temperature slurry bed Fischer Tropsch reactor using an iron based catalyst and an operating temperature of around 240° C.

Comparative example 3—high temperature fluidized bed Fischer Tropsch reactor using an iron based catalyst and an operating temperature of around 340° C.

Invention—low temperature fixed bed Fischer Tropsch reactor using a cobalt based catalyst and an operating temperature of around 200° C.; including concurrent condensate processing and integration of Fischer Tropsch and condensate products prior to distillation.

TABLE 1

| Middle Distillate Product Fraction | Comparative example 1 | Comparative example 2 | Comparative example 3 | Invention (Example 1) |
|---|---|---|---|---|
| $C_5$-$C_{12}$ cut | Paraffin content 100% Aromatics (trace) Oxygenates <1% | Paraffin/olefin ratio 0.45 Aromatics 0% Oxygenates 7% | Paraffin/olefin ratio 0.18 Aromatics 5% Oxygenates 12% | Paraffin content 100% Aromatics (trace) Oxygenates 0% |
| $C_{13}$-$C_{18}$ cut | Paraffin content 100% Aromatics (trace) Oxygenates <1% | Paraffin/olefin ratio 0.88 Aromatics 0% Oxygenates 6% | Paraffin/olefin ratio 0.25 Aromatics 15% Oxygenates 10% | Paraffin content 100% Aromatics (trace) Oxygenates 0% |

It is clear from Table 1 that the products obtained according to the present invention show substantially higher paraffin content and lack contamination from aromatics, olefins and oxygenates. This renders the present products particularly suitable for use as components in aviation and compression ignition engine fuels.

Example 2

A natural gas well is producing 20,794 t/d of natural gas. The natural gas is split into field condensate and sour feed gas resulting in 17,236 t/d of sour natural gas and 3,465 t/d of field condensate, the balance being water. The sour natural gas is treated to remove acid components, water and other impurities and is subsequently subjected to cryogenic distillation to remove LPG. This results in the production, of 14,108 t/d of lean and sweet natural gas serving as feed gas to a GTL section, 1080 t/d of LPG and 408 t/d of plant condensate, the balance consisting of sour water, sulphur and sour fuel gas. The total production of condensate being the combined stream of field condensate and plant condensate amounts 3,873 t/d. The combined condensate contains 24.7% of material with boiling point above 150° C. and 8.2% of material boiling above 250° C. The combined condensate does not contain a measurable fraction of material boiling above 350° C.

The lean and sweet feed gas, mainly consists of methane (89.4% v), ethane (5.3% v) and nitrogen (4.3% v), the balance consisting of traces of carbon dioxide, propane, helium and argon.

The lean and sweet natural gas serving as feed gas to a GTL section is split into two streams which are converted into a first synthesis gas using a partial oxidation process and in a second synthesis gas comprising a steam reforming process. Preparation of the two synthesis gas streams are known in the art and has been described for example in the specification of WO-A-2010/122025. The two synthesis gas streams are applied as a feedstock for a fixed bed Fischer-Tropsch synthesis. Fischer-Tropsch synthesis is known by the art and has been described for example in the specification of WO2003/070857. In a separator system the product of the Fischer-Tropsch synthesis is split into 4 fractions:

1. a gaseous fraction containing C1-C2 hydrocarbons which is used in the process as fuel gas
2. an LPG fraction (C3-C4) which is combined with the LPG obtained from the cryogenic distillation of the treated natural gas
3. a light liquid fraction with hydrocarbons in the range C5-C20
4. a heavy fraction with hydrocarbons in the range C21 and heavier The light liquid fraction is further split into 3 fractions:

5. a liquid fraction with hydrocarbons in the range C5-C8
6. a liquid fraction with hydrocarbons in the range C9-C13 which is used as detergent feedstock
7. a liquid fraction with hydrocarbons in the range C14-C20

Fractions 4 and 7 are combined and are used as feedstock to a hydrocracking/hydroisomerisation unit.

Fraction 5 is combined with combined condensate stream and is used as feedstock to a hydrodesulphurisation unit.

The effluents of both the hydrocracking/hydroisomerisation unit and of the hydrodesulphurisation unit are combined as a feedstock to a first distillation unit yielding LPG, naphtha, kerosene, gas oil and a stream boiling above 350° C. The stream boiling above 350° C. is fed to a first vacuum distillation unit yielding a vacuum gas oil stream, a waxy stream with boiling range 390-540° C. and a residual stream boiling above 540° C. The vacuum gas oil is combined with the gas oil from the first distillation unit. The residual stream is recycled to the hydrocracking/hydroisomerisation unit. The waxy stream with boiling range 390-540° C. is subjected to a catalytic dewaxing step the effluent of which is subjected to a second vacuum distillation unit yielding distillates which are combined with the distillates of the first distillation column and base oils with kinematic viscosity at 100° C. of 3, 4 and 8 cSt respectively. The total yield of final products is given in Table 2.

Example 3

A natural gas well is producing 20,794 t/d of natural gas. The natural gas is split into field condensate and sour feed gas resulting in 17,236 t/d of sour natural gas and 3,465 t/d of field condensate, the balance being water. The sour natural gas is treated to remove acid components, water and other impurities and is subsequently subjected to cryogenic distillation to remove LPG. This results in the production, of 14,108 t/d of lean and sweet natural gas serving as feed gas to a GTL section, 1080 t/d of LPG and 408 t/d of plant condensate, the balance consisting of sour water, sulphur and sour fuel gas. The total production of condensate being the combined stream of field condensate and plant condensate amounts 3,873 t/d. The combined condensate contains 24.7% of material with boiling point above 150° C. and 8.2% of material boiling above 250° C. The combined condensate does not contain a measurable fraction of material boiling above 350° C.

The lean and sweet feed gas, mainly consists of methane (89.4% v), ethane (5.3% v) and nitrogen (4.3% v), the balance consisting of traces of carbon dioxide, propane, helium and argon.

The lean and sweet natural gas serving as feed gas to a GTL section is split into two streams which are converted into a first synthesis gas using a partial oxidation process and in a second synthesis gas comprising a steam reforming process. Preparation of the two synthesis gas streams are known in the art and has been described for example in the specification of WO-A-2010/122025. The two synthesis gas streams are applied as a feedstock for a fixed bed Fischer-Tropsch synthesis. Fischer-Tropsch synthesis is known by the art and has been described for example in the specification of WO2003/070857. In a separator system the product of the Fischer-Tropsch synthesis is split into 4 fractions:

1. a gaseous fraction containing C1-C2 hydrocarbons which is used in the process as fuel gas
2. an LPG fraction (C3-C4) which is combined with the LPG obtained from the cryogenic distillation of the treated natural gas
3. a light liquid fraction with hydrocarbons in the range C5-C20
4. a heavy fraction with hydrocarbons in the range C21 and heavier The light liquid fraction is subjected to a hydrogenation step over a nickel containing catalyst. In this hydrogenation step olefins and oxygenates are hydrogenated to paraffins without substantial reduction of molecular weight.

The effluent of the hydrogenation step is further split into 3 fractions:

5. a liquid fraction with hydrocarbons in the range C5-C8
6. a liquid fraction with hydrocarbons in the range C9-C13 which is used as detergent feedstock
7. a liquid fraction with hydrocarbons in the range C14-C20

The combined condensate is subjected to a hydrodesulphurisation step to reduce the sulphur content. Fractions 4, 7 and the hydrodesulphurised combined condensate are combined and used as feedstock to a hydrocracking/hydroisomerisation unit.

The effluent of the hydrocracking/hydroisomerisation unit is combined with stream 5 and used as as a feedstock to a first distillation unit yielding LPG, naphtha, kerosene, gas oil and a stream boiling above 350° C. The stream boiling above 350° C. is fed to a first vacuum distillation unit yielding a vacuum gas oil stream, a waxy stream with boiling range 390-540° C. and a residual stream boiling above 540° C. The vacuum gas oil is combined with the gas oil from the first distillation unit. The residual stream is recycled to the hydrocracking/hydroisomerisation unit. The waxy stream with boiling range 390-540° C. is subjected to a catalytic dewaxing step the effluent of which is subjected to a second vacuum distillation unit yielding distillates which are combined with the distillates of the first distillation column and base oils with kinematic viscosity at 100° C. of 3, 4 and 8 cSt respectively. The total yield of final products is given in Table 2.

Comparative Example 4

A natural gas well is producing 20,794 t/d of natural gas. The natural gas is split into field condensate and sour feed gas resulting in 17,236 t/d of sour natural gas and 3,465 t/d of field condensate, the balance being water. The sour natural gas is treated to remove acid components, water and other impurities and is subsequently subjected to cryogenic distillation to remove LPG. This results in the production, of 14,108 t/d of lean and sweet natural gas serving as feed gas to a GTL section, 1080 t/d of LPG and 408 t/d of plant condensate, the balance consisting of sour water, sulphur and sour fuel gas. The total production of condensate being the combined stream of field condensate and plant condensate amounts 3,873 t/d. The combined condensate contains 24.7% of material with boiling point above 150° C. and 8.2% of material boiling above 250° C. The combined condensate does not contain a measurable fraction of material boiling above 350° C. The combined condensate is processed in a hydrotreating unit to reduce its sulphur content.

The lean and sweet feed gas, mainly consists of methane (89.4% v), ethane (5.3% v) and nitrogen (4.3% v), the balance consisting of traces of carbon dioxide, propane, helium and argon.

The lean and sweet natural gas serving as feed gas to a GTL section is split into two streams which are converted into a first synthesis gas using a partial oxidation process and in a second synthesis gas comprising a steam reforming process. The two synthesis gas streams are applied as a feedstock for a fixed bed Fischer-Tropsch synthesis. In a separator system the product of the Fischer-Tropsch synthesis is split into 4 fractions:

1. a gaseous fraction containing C1-C2 hydrocarbons which is used in the process as fuel gas
2. an LPG fraction (C3-C4) which is combined with the LPG obtained from the cryogenic distillation of the treated natural gas
3. a light liquid fraction with hydrocarbons in the range C5-C20
4. a heavy fraction with hydrocarbons in the range C21 and heavier The light liquid fraction is further split into 3 fractions:

5. a liquid fraction with hydrocarbons in the range C5-C8
6. a liquid fraction with hydrocarbons in the range C9-C13 which is used as detergent feedstock
7. a liquid fraction with hydrocarbons in the range C14-C20

Fractions 3, 4 and 7 are combined and are used as feedstock to a hydrocracking/hydroisomerisation unit. The effluent of the hydrocracking/hydroisomerisation unit are separated in a first distillation unit yielding LPG, naphtha, kerosene, gas oil and a stream boiling above 350° C. The stream boiling above 350° C. is fed to a first vacuum distillation unit yielding a vacuum gas oil stream, a waxy stream with boiling range 390-540° C. and a residual stream boiling above 540° C. The vacuum gas oil is combined with the gas oil from the first distillation unit. The residual stream is recycled to the hydrocracking/hydroisomerisation unit. The waxy stream with boiling range 390-540° C. is subjected to a catalytic dewaxing step the effluent of which is subjected to a second vacuum distillation unit yielding distillates which are combined with the distillates of the first distillation column and base oils with kinematic viscosity at 100° C. of 3, 4 and 8 cSt respectively. The total yield of final products is given in Table 2.

TABLE 2

| production | Example 2 (bbl/d) | Example 3 (bbl/d) | Comparative Example 4 (bbl/d) |
|---|---|---|---|
| LPG | 18385 | 18435 | 18385 |
| C9-C13 detergent feedstock | 3430 | 3430 | 3430 |
| naphtha | 43935 | 44090 | 19064 |
| kerosene | 16309 | 16215 | 11612 |
| gas oil | 22660 | 22539 | 20232 |
| BO3 | 3678 | 3678 | 3678 |
| BO4 | 6175 | 6175 | 6175 |
| BO8 | 4300 | 4300 | 4300 |
| hydrotreated condensate | 0 | 0 | 31995 |
| total | 118872 | 118862 | 118871 |

The results in Table 2 show that a high yield of middle distillates products including, kerosene and gas oil was obtained through a Fischer-Tropsch process in which processing of condensate occurs simultaneously with the Fischer-Tropsch reaction (see Table 2, Example 2 and 3). Utilization of condensate to produce middle distillates including, kerosene and gas oil results in a higher yield (see Table 2, Example 2 and 3) than the yield of, kerosene and gas oil obtained without the utilisation of condensate (see Comparative Example 4).

That which is claimed is:

1. A process for production of a middle distillate fraction from a gas-to-liquid (GTL) conversion comprising the steps of:

(a) providing a feed stream comprising a natural gas and separating a condensate from the natural gas feed stream to produce a condensate stream and a natural gas feed stream;

(b) processing the natural gas feed stream via a Fischer-Tropsch reaction to generate a long chain hydrocarbon product stream;

(c) processing the long chain hydrocarbon product stream via a heavy paraffinic conversion step in order to produce a Fischer-Tropsch (FT) product stream;

(d) treating the condensate stream of step (a) with a desulfurization step to generate a condensate product stream;

(e) combining the FT product stream of step (c) with the condensate product stream of step (d) in order to provide a distillate feed stream; and (f) performing a distillation step on the distillation feed stream, wherein the distillation step provides for isolation of middle distillate products;

wherein the steps (b) to (c) occur substantially concurrently with step (d).

2. The process of claim 1, wherein the middle distillate products comprise a middle distillate naphtha, a middle distillate kerosene and/or a middle distillate gas oil or diesel oil component.

3. The process of claim 1, wherein all steps (a)-(f) occur at a single location.

4. The process of claim 1 wherein the Fischer-Tropsch reaction comprises a low temperature Fischer-Tropsch (LTFT) reaction.

5. The process of claim 4, wherein the LTFT reaction occurs at a temperature of least 150° C. and at most 250° C.

6. The process of claim 4, wherein LTFT reaction comprises a cobalt based catalyst.

7. The process of claim 4, wherein the LTFT reaction comprises a fixed bed reactor.

8. The process of claim 1 wherein the process comprises an additional step of dividing the long chain hydrocarbon product stream of step (b) in to a light product stream and a heavy product stream, and combining the light product stream with either:

(i) the condensate feed stream; or (ii) the condensate product stream; or (iii) both the condensate feed stream and the condensate product stream, prior to the distillation step (f).

9. The process of claim 1, wherein the process comprises an additional step of dividing the FT product stream of step (c) in to light FT and heavy FT product streams, and providing an additional processing step for the light FT product stream so as to divide the light FT product stream in to very light FT products, and other FT products which are processed further, separated or recombined with the heavy FT product stream.

10. The process of claim 9, wherein the very light FT products are combined with the either:

(i) the condensate feed stream; or (ii) the condensate product stream; or (iii) both the condensate feed stream and the condensate product stream, prior to the distillation step (f).

11. The process of claim 1, wherein steps (c) and (d) occur in a single reactor.

* * * * *